US010488082B2

(12) United States Patent
Landry et al.

(10) Patent No.: US 10,488,082 B2
(45) Date of Patent: Nov. 26, 2019

(54) MULTI-DEWAR COOLING SYSTEM

(71) Applicant: Goodrich Corporation, Charlotte, NC (US)

(72) Inventors: Joseph W. Landry, North Reading, MA (US); John Anthony Tejada, Londonderry, NH (US)

(73) Assignee: Goodrich Corporation, Charlotte, NC (US)

( * ) Notice: Subject to any disclaimer, the term of this patent is extended or adjusted under 35 U.S.C. 154(b) by 0 days.

(21) Appl. No.: 15/917,078

(22) Filed: Mar. 9, 2018

(65) Prior Publication Data

US 2018/0195774 A1 Jul. 12, 2018

Related U.S. Application Data

(62) Division of application No. 14/532,339, filed on Nov. 4, 2014, now Pat. No. 9,927,152.

(51) Int. Cl.
*F25B 9/14* (2006.01)
*F25B 9/06* (2006.01)

(52) U.S. Cl.
CPC ..... *F25B 9/14* (2013.01); *F25B 9/06* (2013.01); *F25B 2309/1428* (2013.01); *F25B 2600/025* (2013.01); *F25B 2600/2515* (2013.01); *F25B 2700/21* (2013.01)

(58) Field of Classification Search
CPC ..... F25B 6/02; F25B 9/06; F25B 9/14
See application file for complete search history.

(56) References Cited

U.S. PATENT DOCUMENTS

| | | | | |
|---|---|---|---|---|
| 6,308,520 | B1 | 10/2001 | Inoue et al. | |
| 6,378,312 | B1 * | 4/2002 | Wang | F25B 9/145 60/520 |
| 8,528,359 | B2 | 9/2013 | Lifson et al. | |
| 2006/0288710 | A1 | 12/2006 | Legall et al. | |
| 2011/0160064 | A1 * | 6/2011 | Pfleiderer | F25B 9/145 505/163 |
| 2012/0085121 | A1 | 4/2012 | Longsworth | |
| 2013/0192275 | A1 | 8/2013 | Loung et al. | |
| 2014/0123684 | A1 | 5/2014 | Toft et al. | |
| 2014/0245754 | A1 * | 9/2014 | Takahashi | F25B 9/14 62/6 |

OTHER PUBLICATIONS

Extended European Search Report, of the European Patent Office, dated Mar. 21, 2016, issued in corresponding European Patent Application No. 15193021.1.

* cited by examiner

*Primary Examiner* — Brian M King
(74) *Attorney, Agent, or Firm* — Locke Lord LLP; Daniel J. Fiorello; Joshua L. Jones

(57) ABSTRACT

A cooling system includes a first dewar configured to house a first optical imaging device, a second dewar configured to house a second optical imaging device, and a Stirling cycle refrigerator. The Stirling cycle refrigerator can include a compressor, a first expander in fluid communication with the compressor and in thermal communication with the first dewar, and a second expander in fluid communication with the compressor and in thermal communication with the second dewar.

5 Claims, 2 Drawing Sheets

MULTI-DEWAR COOLING SYSTEM

CROSS-REFERENCE TO RELATED APPLICATION

This application is a divisional application of U.S. application Ser. No. 14/532,339 filed no Nov. 4, 2014 the contents of which is incorporated herein by reference.

BACKGROUND

1. Field

The present disclosure relates to cooling systems, more particularly to cooling systems for optical systems having dewars.

2. Description of Related Art

Certain optical systems (e.g., infrared optical systems) include multiple imaging modes (e.g., MWIR, LWIR, SWIR) which each require an optical imaging device operatively associated with a lens or other optical opening. The heat from the optical chip itself, mechanical hardware, and the surrounding electrical systems can degrade the image quality by washing out the image.

To address this, cooling systems can be employed. In some cases, the optical chips are placed in a dewar for active cooling. Since each dewar in a system can have differing cooling requirements, each dewar requires its own dedicated compressor to selectively and actively cool each optical chip to predetermined temperatures independently. Having multiple compressors increases the size, weight, and complexity of the optical systems relative to systems where cooling is not required.

Such conventional methods and systems have generally been considered satisfactory for their intended purpose. However, there is still a need in the art for improved cooling systems for optical systems. The present disclosure provides a solution for this need.

SUMMARY

In at least one aspect of this disclosure, a cooling system includes a first dewar configured to house a first optical imaging device, a second dewar configured to house a second optical imaging device, and a Stirling cycle refrigerator. The Stirling cycle refrigerator can include a compressor, a first expander in fluid communication with the compressor and in thermal communication with the first dewar, and a second expander in fluid communication with the compressor and in thermal communication with the second dewar.

The system can further include a gas control valve operatively disposed between the second expander and the compressor to independently control fluid flow between the second expander and the compressor, independent relative to the fluid flow between the first expander and the compressor.

A control system can be operatively connected to the compressor to control a compressor speed. The control system can be operatively connected to the gas control valve to control the second fluid flow between the second expander and the compressor.

The system can include a first temperature sensor operatively connected to the first dewar. The system can further include a second temperature sensor operatively connected to the second dewar.

The control system can be operatively connected to at least one of the first temperature sensor or the second temperature sensor to receive temperature signals, wherein the control system controls the compressor and the gas control valve based on the temperature signals to regulate a temperature of the first dewar and/or the second dewar.

In at least one aspect of this disclosure, a method of cooling multiple dewars independently of each other using a single compressor includes controlling a compressor speed to regulate temperature of a first dewar in thermal communication with a first expander, which is in fluid communication with the compressor, to achieve a predetermined temperature of the first dewar. The method also includes employing (e.g., controlling) a gas control valve to regulate temperature of a second dewar in thermal communication with a second expander, which is in fluid communication with the compressor, to achieve a predetermined temperature of the second dewar.

In certain embodiments, controlling the gas control valve can include modifying the flow rate of coolant between the second expander and the compressor. Controlling the gas control valve can include restricting flow of coolant between the second expander and the compressor. In certain embodiments, controlling the gas control valve can include modifying a working volume between the second expander and the compressor. The method can further include receiving a signal indicative of temperature of at least one of the first dewar or the second dewar and controlling at least one of the compressor speed or the gas control valve based on the signal.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
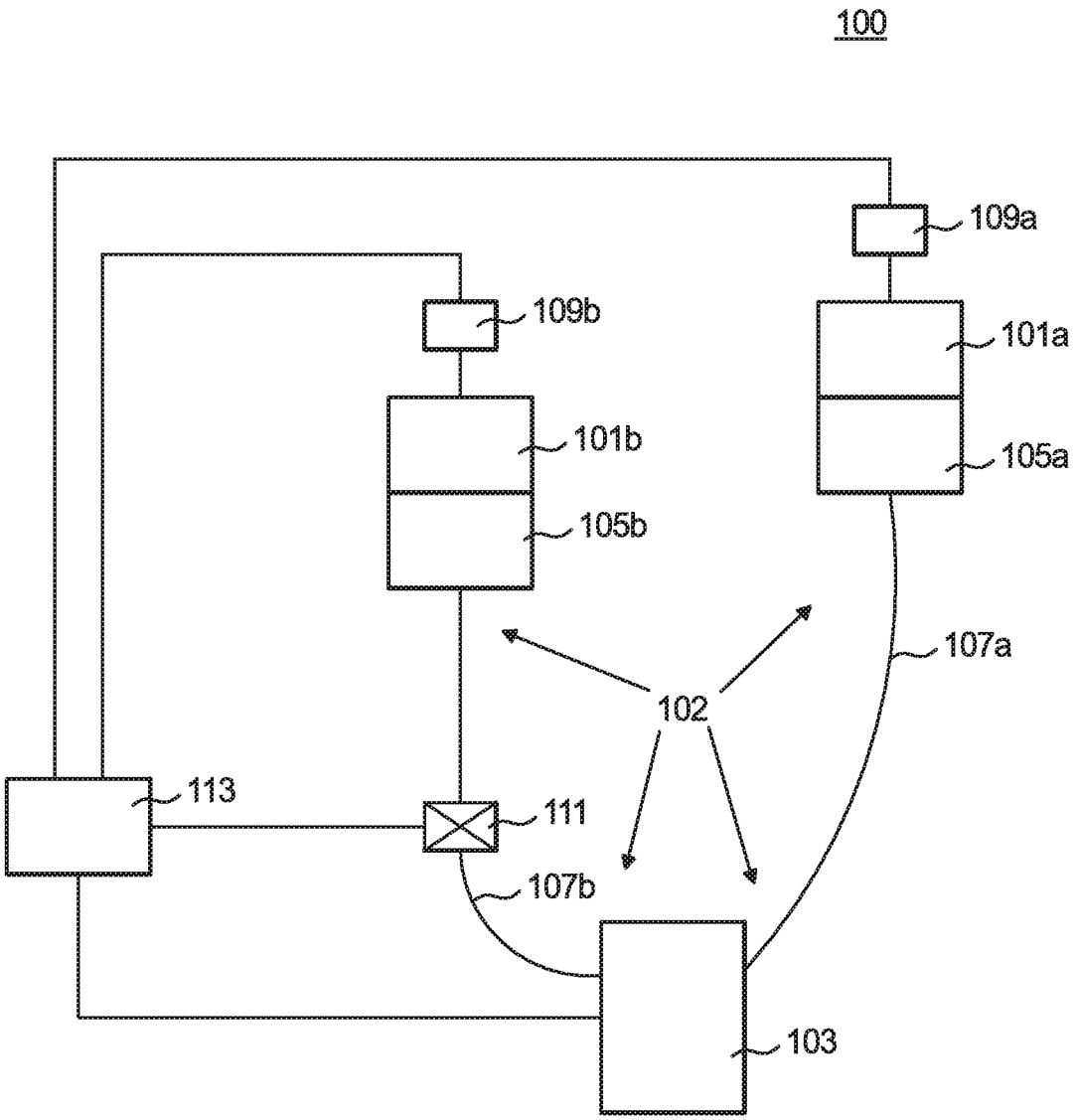
FIG. 1 is a schematic view of an embodiment of a cooling system in accordance with this disclosure, showing a compressor connected to a plurality of dewars.
Figure 2:
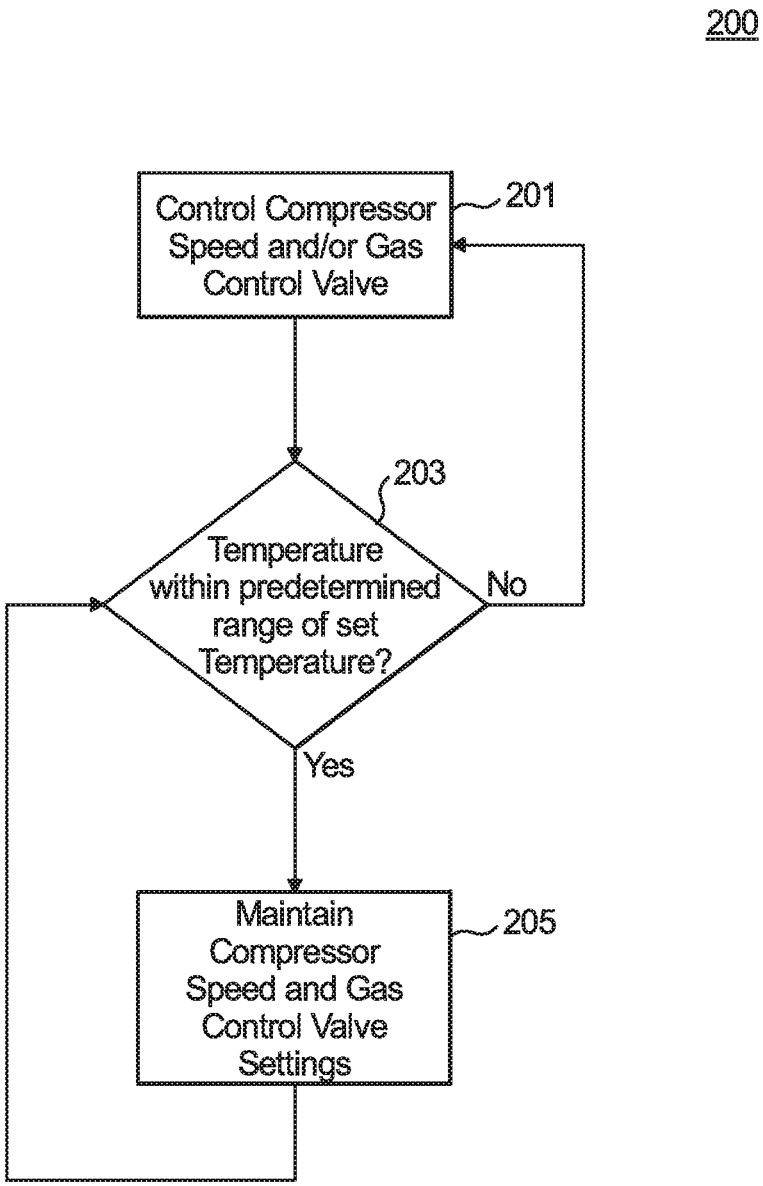
FIG. 2 is a block diagram of an embodiment of a method in accordance with this disclosure.

Reference will now be made to the drawings wherein like reference numerals identify similar structural features or aspects of the subject disclosure. For purposes of explanation and illustration, and not limitation, an illustrative view of an embodiment of a cooling system in accordance with the disclosure is shown in FIG. 1 and is designated generally by reference character 100. Other aspects of this disclosure are shown in FIG. 2. The systems and methods described herein can be used to cool any suitable electronics system (e.g., infrared imaging devices).

In at least one aspect of this disclosure, a cooling system 100 includes a first dewar 101*a* configured to hold a first optical imaging device (e.g., an infrared imaging chip). The system 100 also includes a second dewar 101*b* configured to hold a second optical imaging device. The dewars 101*a* and 101*b* can have any suitable shape and/or size and can be made of any suitable material (e.g., metal). The dewars 101*a* and 101*b* can also include a suitable port for allowing infrared radiation or other light to reach the optical imaging device.

The system 100 further includes a split Stirling cycle refrigerator 102 (e.g., split linear type or split rotary type). The split Stirling cycle refrigerator 102 includes a compressor 103 and a first expander 105*a* that is in fluid communication with the compressor 103 and in thermal communication with the first dewar 101*a*. The refrigerator 102 also includes a second expander 105*b* in fluid communication with the compressor 103 and in thermal communication with the second dewar 101*b*. The expanders 105*a*, 105*b* are configured to allow a coolant (e.g., air or helium) within the refrigerator tubes 107*a*, 107*b* to accept heat from the dewars 101*a* and 101*b*. Due to an oscillatory motion of coolant within the tubes 107*a*, 107*b* based on the Stirling cycle, and due to the work acting on the system 100 by the compressor 103, heat can be pumped from the dewar to a heat sink (e.g., the atmosphere away from the dewar). As one having ordinary skill in the art will readily appreciate, a regenerator and/or a displacer can be included to enhance the efficiency of the Stirling refrigerator 102.

The system 100 can further include a gas control valve 111 operatively disposed between the second expander 101*b* and the compressor 103 to independently control a second fluid flow between the second expander 101*b* and the compressor 103 independently of the fluid flowing between first expander 105*a* and the compressor 103. The gas control valve 111 can be of any suitable valve type for controlling flow rate, working fluid volume, or any other characteristic which affects thermal efficiency of the refrigerator 102 between the second expander 105*b* and the compressor 103. This allows independent cooling of the first dewar 101*a* and the second dewar 101*b*. For example, the first dewar 101*a* can be cooled to a certain temperature by setting the speed of the compressor 103 and the second dewar 101*b* can be cooled to a different temperature by modifying the gas control valve 111 to change the flow characteristics between the second expander 105*b* and the compressor 103.

As shown in FIG. 1, the system 100 can further include a first temperature sensor 109*a* operatively connected to the first dewar 101*a* for sensing the temperature thereof. The system 100 can also include a second temperature sensor 109*b* operatively connected to the second dewar 101*b* for sensing the temperature of the second dewar 101*b*.

The system 100 includes a control system 113 operatively connected to the compressor 103 to control compressor speed. The control system 113 is also operatively connected to the gas control valve 111 to control the fluid flow between the second expander 105*b* and the compressor 103.

The control system 113 is operatively connected to the first temperature sensor 109*a* and the second temperature sensor 109*b* to receive temperature signals. Control system 113 controls the compressor 103 and/or the gas control valve 111 based on the temperature signals in order to regulate a temperature of the first dewar 101*a* and/or the second dewar 101*b* as necessary and/or predetermined.

Referring to FIG. 2, in at least one aspect of this disclosure, a method 200 of cooling multiple dewars 101*a* and 101*b* independently of each other using a single compressor 103 includes controlling a compressor speed to regulate temperature of a first dewar 101*a* as disclosed above which is in thermal communication with a first expander 105*a* as described above to achieve a predetermined temperature of the first dewar 101*a* as shown in block 201. Also as shown in block 201, the method also includes controlling a gas control valve 111 to regulate temperature of a second dewar 101*b* as disclosed herein which is in thermal communication with a second expander 105*b* as described above to achieve a predetermined temperature of the second dewar 101*b*.

In certain embodiments, controlling the gas control valve 111 can include modifying the flow rate of a coolant between the second expander 105*b* and the compressor 103. Controlling the gas control valve 111 can include restricting flow of a coolant between the second expander 105*b* and the compressor 103. In certain embodiments, controlling the gas control valve 111 can include modifying a working volume between the second expander 105*b* and the compressor 103. Any suitable control input is contemplated herein.

As in block 203, the method can further include receiving a signal indicative of temperature of at least one of the first dewar 101*a* or the second dewar 101*b* and controlling at least one of the compressor speed or the gas control valve 111 based on the signal. For example, if a predetermined temperature for either or both dewars is not reached, the method 200 can revert back to block 201 to control the compressor speed and/or the control valves further. If the predetermined temperature is reached, the method can include maintaining the inputs at block 203 until temperature of the dewars is no longer at the set temperature or range thereof.

While shown and describe in the context of a dual dewar system, those skilled in the art will readily appreciate that any suitable number of additional dewars can be included, e.g., connected the compressor by way of a respective valve. While described in the context of an optical focal plane arrays (FPA's), those skilled in the art will readily appreciate that the systems and methods described herein can be applied to control temperature in any other suitable application.

The methods and systems of the present disclosure, as described above and shown in the drawings, provide for cooling systems with superior properties including independent temperature control in systems with reduced size and increased efficiency. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A method of cooling multiple dewars independently of each other using a single compressor, comprising:

controlling a compressor speed of a single compressor to regulate temperature of a first dewar in thermal communication with a first expander, which is in direct fluid communication with the single compressor, to achieve a predetermined temperature of the first dewar without using a valve to regulate temperature of the first dewar; and controlling a single gas control valve to regulate temperature of a second dewar in thermal communication with a second expander, which is in fluid communication with the single compressor through the single gas control valve, to achieve a predetermined temperature of the second dewar, wherein the temperature of the first dewar and the second dewar are controlled independently of each other using the single compressor and the single gas control valve.

2. The method of claim 1, wherein controlling the single gas control valve includes modifying the flow rate of a coolant between the second expander and the single compressor.

3. The method of claim 1, wherein controlling the single gas control valve includes restricting flow of a coolant between the second expander and the single compressor.

4. The method of claim 1, wherein controlling the single gas control valve includes modifying a working volume between the second expander and the single compressor.

5. The method of claim 1, further comprising receiving a signal indicative of temperature of at least one of the first dewar or the second dewar and controlling at least one of the single compressor speed or the single gas control valve based on the signal.

* * * * *